United States Patent [19]

Dlugopolski

[11] 4,244,509

[45] Jan. 13, 1981

[54] STACKABLE FOLDING BOX WITH TRUNCATED CROSS SECTION

[75] Inventor: Joseph Dlugopolski, Elk Grove Village, Ill.

[73] Assignee: Fidelity Container Corporation, Elk Grove Village, Ill.

[21] Appl. No.: 39,458

[22] Filed: May 16, 1979

[51] Int. Cl.[3] ..... B65D 5/22; B65D 5/52

[52] U.S. Cl. ..... 229/36; 206/504; 206/602; 229/DIG. 11

[58] Field of Search ..... 229/33, 36, DIG. 11; 206/602, 504, 821

[56] References Cited

U.S. PATENT DOCUMENTS

| | | | |
|---|---|---|---|
| 2,132,632 | 10/1930 | Kondolf | 229/36 X |
| 2,634,041 | 4/1953 | Barnett | 206/602 X |
| 3,531,170 | 9/1970 | Boyer | 229/36 X |
| 3,933,268 | 1/1976 | Baske | 206/504 X |
| 4,053,101 | 10/1977 | Hart, Jr. | 229/36 |
| 4,113,100 | 9/1978 | Soja et al. | 206/602 |
| 4,128,167 | 12/1978 | Hogshead | 229/36 X |

*Primary Examiner*—Davis T. Moorhead

*Attorney, Agent, or Firm*—Laff, Whitesel & Rockman

[57] ABSTRACT

A cardboard box, made from a single cardboard blank, has a slanting upper surface to enable the contents of the box to be clearly seen. Opposed interlocking points are formed along the slanting side edge. When one such box is inverted and stacked on another, the interlocking points come into abutment and keep the boxes from sliding apart. As a result, boxes with truncated triangular cross-section may be stacked and shipped as if they were rectangular in all dimensions.

9 Claims, 6 Drawing Figures

STACKABLE FOLDING BOX WITH TRUNCATED CROSS SECTION

This invention relates to cartons and boxes and more particularly to stackable, triangular cartons or boxes with truncated cross sections, which may be nested to minimize volume during shipping and to provide stable stacking during storage.

Among the specialty boxes which are often used are counter-top boxes having a slanting top display surface. The slanting top enables a person looking at a display to see items at the back of the box as easily as at the front of the box. This means that the box has a generally truncated triangular cross-section. However, in shipment, during storage, and while handling, the boxes should be in generally rectangular boxes. Otherwise, they do not stack, and therefore, would have to be handled one at a time. When shipped, the transporting company would almost certainly require the boxes to be packed in rectangular outer boxes. As a result, the prior practice has generally been to use some kind of insert above the narrow end of the truncated triangular box to fill the extra space within an outer rectangular box. This is wasteful since it then is necessary to ship and store empty space.

Accordingly, the object of this invention is to provide new and improved means for and methods of shipping boxes having a somewhat truncated triangular cross-section.

Another object of the invention is to provide such boxes which may be stacked with a generally rectangular form. Here, an object is to provide interlocking means so that the generally truncated triangular boxes will not tend to slip past each other. Therefore, an object is to enable these boxes to be stacked over extended periods of time without danger of box collapse.

In keeping with an aspect of the invention, these and other objects of the invention are accomplished by providing a box made from a single blank. The blank is cut in a manner which forms an upstanding point on each of two opposed edges of the slanted surface. When two of the boxes are placed together, with one inverted over the other, they nest to jointly form a rectangular prism. The two upstanding points engage and abut against each other, to prevent the boxes from sliding apart.

A preferred embodiment will be understood best from a study of the attached drawings, wherein.

Figure 1:
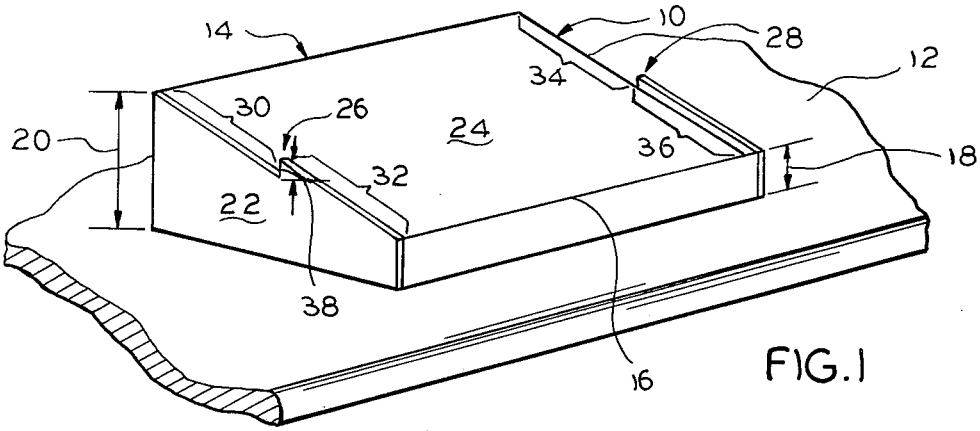
FIG. 1 is a perspective view which shows a single one of the inventive boxes and illustrates why a slanting top is desirable.

In FIG. 1, the inventive box 10 is shown as sitting on a flat surface 12, which may be a counter top, shelf, or table, for example. The surface 12 is very often high enough so that it would be difficult to see into the rear parts of the box 10 if it has a flat top. Therefore, it is conventional to set the box in a manner which elevates its rear edge 14, as compared to the level of its front edge. By way of example, the box 10 may contain an egg-crate type of dividers to provide a plurality of small compartments, each of which might hold a different size of nuts or bolts. It is desirable for a customer to be able to carefully inspect the bins to find a particular nut or bolt. Therefore, he will want to see into the bins at the back of the box.

The front side of the box has a height 18 and the rear side has a height 20. Therefore, the side panel 22 and the box cross section generally has a truncated, triangular shape, and the top surface 24 sits at a slant and forms an inclined plane, with respect to the horizontal upper surface of table 12.

The box 10 has a pair of interlocking points 26, 28 individually formed along opposite edges of the slanting top 24. Each of the two pairs of edges 30, 32, and 34, 36, respectively, are parallel to but displaced from each other. The edge 32, for example, is displaced upwardly by a distance 38, as compared to the position of the edge 30. This forms two interlocking points 26, 28.

Figure 2:
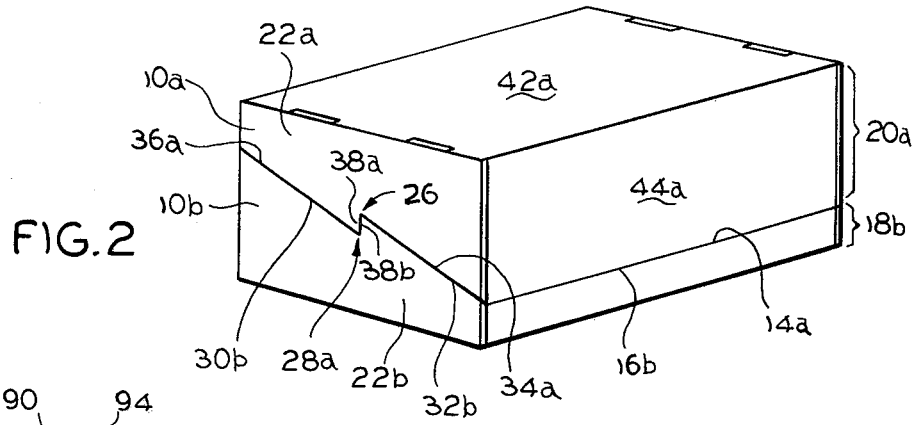
FIG. 2 is a perspective view which shows a nested pair of the inventive boxes, with one box inverted and positioned over the other box.

Therefore, if one box 10*a* (FIG. 2) is inverted relative to and placed upon an identical box 10*b*, the two interlocking points 26, 28 come together and into abutment. (The same reference numerals are used for boxes 10*a*, 10*b*, with suffix letters a and b to differentiate the respective box parts.) The vertical edge 38*a* on upper box 10*a* abuts against the vertical edge 38*b* on the lower box 10*b*. These abutting edges form stop walls to keep the box 10*a* from slipping off the inclined plane formed by the upper surface of box 10*b*. The combined height 20*a* of the back and the height 18*b* of the front are such that they jointly form a desired vertical dimension for a rectangular prism.

Figure 3:
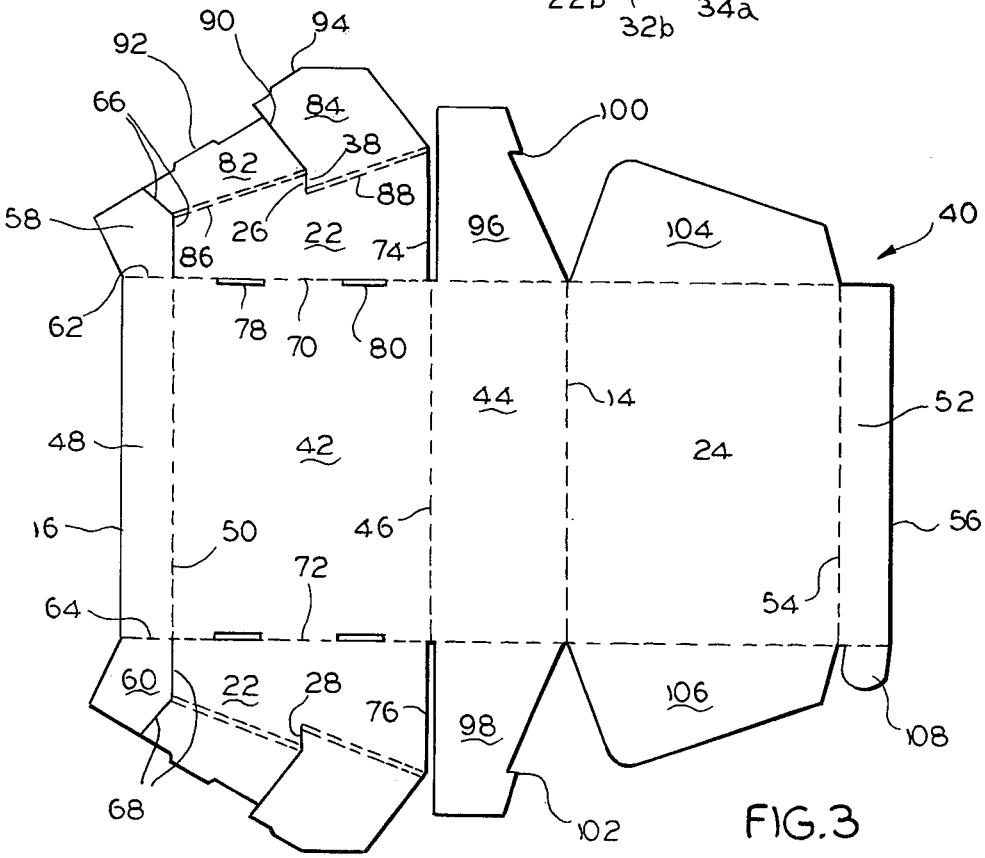
FIG. 3 is a plain view of the blank used to make the box.

The blank 40 for making the stackable, truncated triangular box is seen in the plan view of FIG. 3. The blank includes top 24 and bottom 42 which are separated by an intermediate back panel 44 formed by two spaced, parallel fold lines 46, 14. The outside end of bottom panel 42 terminates in the front panel 48 having fold line 50 along one side and box edge 16 along the other side. The outside end of top panel 24 terminates in a closing flap 52 having a fold line 54 along one side and a box edge 56 along the opposite side. The opposite ends of the front panel 48 terminate in opposing tuck flaps 58, 60, defined by fold lines 62, 64, respectively. The inside edges of tuck flaps 58, 60 are separated from the rest of the blank by cut lines 66, 68.

The opposite ends of bottom 42 have complex flaps defined by fold lines 70, 72; cut lines 66, 68; cut lines 74, 76; and the outside perimeter of the blank. The upper complex end flap, for example, includes the end panel 22 which gives the box its truncated triangular cross-section. Two locking slots 78, 80 are formed on the bottom panel side of fold line 70. Two separate locking flaps 82, 84 are formed on the outside end of the end panel 22, and defined by double fold lines 86, 88. These double lines form a space for receiving tuck flaps 58, 96 when the blank is folded to form the box. The end flaps 82, 84 are separated by an obtusely angled cut line 90. The lower end of cut line 90 forms the vertical abutment edge 38 which produces the interlocking point 26. The obtuse angle of cut line 90 brings the two edges of side panel 22 and end locking flap 82 into spaced parallel alignment when the blank is folded along line 86, thereby forming a double wall thickness at the interlocking point 26.

The lower complex panel at the opposite end of bottom 42 (i.e. below of fold line 72 as viewed in FIG. 3) is indentical with the upper complex panel except that it is a mirror image thereof.

A pair of tuck flaps 96, 98 are formed on opposite ends of the intermediate back panel 44. These tuck flaps have points 100, 102 which coincide with the locking points 26, 28 after the box is folded.

The top panel 24 has a pair of end top panel flaps 104, 106 which fold over and slip inside the side panels 22 when the top 24 is closed over the box. The flap 52 fits behind the front panel 48. A tab 108 is formed on at least one end of front panel 52 to fit under the end flaps 104, 106 on the top panel 24.

Figure 4:
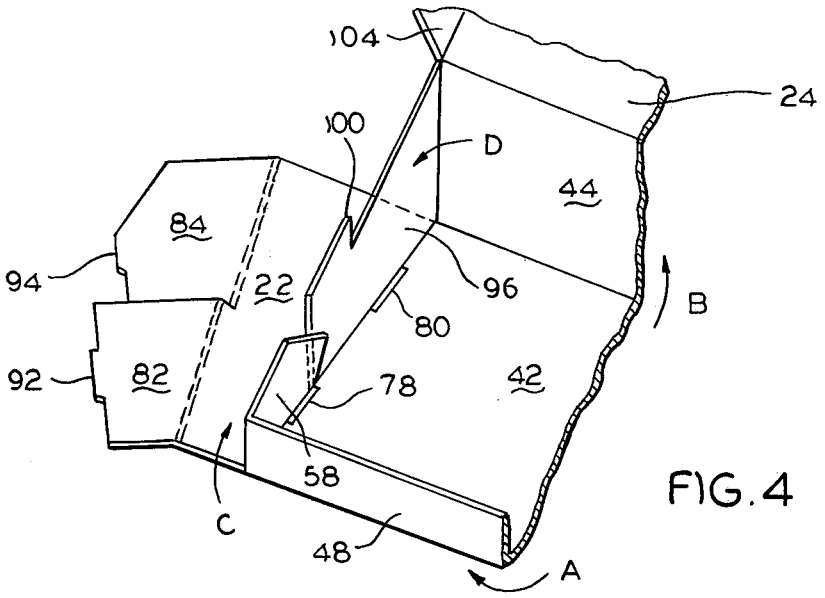
FIGS. 4–6 are three stop motions views showing how the blank is folded to form a complete box.
Figure 5:
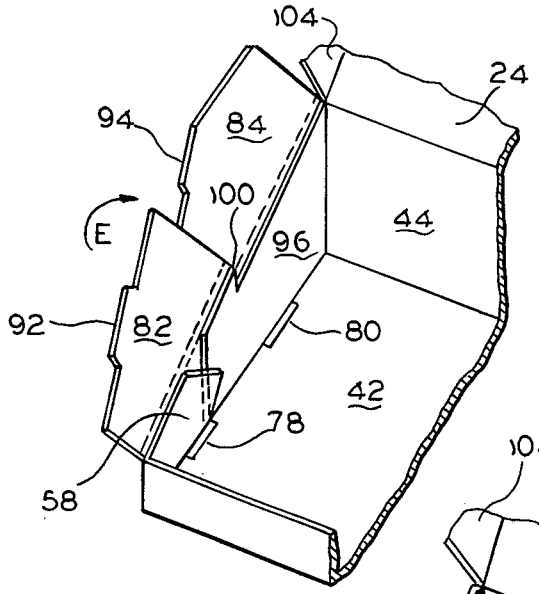
Figure 6:
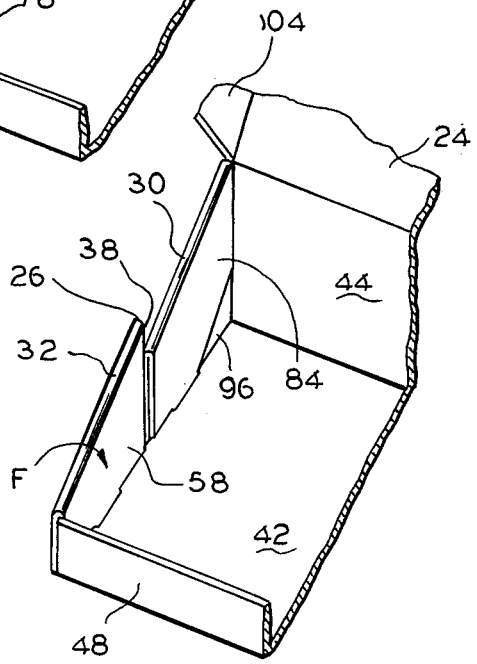

The articulation of the end panels, as the blank folds into the box, is seen in the stop motion of FIGS. 4–6. The front panel 48 and the back intermediate panel 44 are brought up in directions A, B. The tuck flaps 58, 96 are folded in directions C, D (FIG. 4).

Next, the side panel 22 and end locking flaps 82, 84 are brought up in direction E to confront tuck flaps 58, 96. The locking flaps 82, 84 are folded over the tuck flaps 58, 96 and tabs 92, 94 fit into the locking slots 78, 80 on the bottom 42 of the box.

The locking flap 82 folds over point 100 on the tuck flap 96 to form the interlocking point and the edge 32 (seen in FIG. 1). The locking flap 84 fits over the tuck flap 96 to form the edge 30.

The top or cover panel 24 is brought forward with end flap 104 fitting inside the box, as viewed in FIG. 6. The front flap 52 fits behind the front panel 48. The box now has the configuration seen in FIG. 1.

Those who are skilled in the art will readily perceive how to modify the system. Therefore, the appended claims are to be construed to cover all equivalent structures.

I claim:

1. An open top, counter display cardboard box made from a single unitary blank having an upper surface slanting upwardly from a relatively low front wall to a relatively high back wall and forming an inclined plane when said box is resting in a normal position, said box having opposed upstanding side walls, integrally joined to a bottom surface and terminating opposite edges of said upper surface, said upstanding side walls having opposed interlocking abutment points formed along opposed upper edges thereof, said upper surface being a top panel which either folds over to close said box or folds open to disclose the content thereof in a counter display, said box being shaped and proportioned so that a pair of said boxes may be inverted relative to each other and stacked one upon the other with said slanting upper surfaces in face-to-face contact and with the interlocking points on the two boxes in abutting contact.

2. The box of claim 1 wherein said stacked pair of boxes form a rectangular prism.

3. The box of claim 1 wherein said interlocking points are formed along said inclined plane midway between said front and back.

4. A unitary blank for a non-rectangular folding box comprising top and bottom panels separated by an intermediate panel having a predetermined width for forming a back panel on a folded box, said bottom panel terminating in a panel of less than said predetermined width which folds to become the front panel on said box, whereby after the box is folded its top panel slants from the back panel having the predetermined height to the front panel having less than the predetermined height, said bottom panel terminating on either end in end panels having a generally truncated triangular shape with a locking point in the middle of the longest side of said triangle to complete the folded box with the slanting top.

5. A unitary blank for a non-rectangular folding box comprising top and bottom panels separated by an intermediate panel having a predetermined width for forming a back panel on a folded box, said bottom panel terminating in a panel of less than said predetermined width which folds to become the front panel on said box whereby, after the box is folded, its top panel slants from the back panel having the predetermined height to the front panel having less than the predetermined height, said bottom panel terminating on either end in end panels having a generally truncated triangular shape with an interlocking point in approximately the middle of the longest side of said triangle to complete the folded box with the slanting top, said box being shaped and proportioned so that a pair of said boxes may be inverted relative to each other and stacked one upon the other to form a rectangular prism with said slanting upper surfaces in face-to-face contact and with the interlocking points on the two boxes in abutting contact, each of said truncated triangular panels forming a part of a complex end flap which includes said truncated triangular panel connected on one side to the ends of said bottom panel and two locking flaps connected to a side of said truncated triangular panel which is opposite said one side, said locking flaps being connected to said truncated triangular panel by two spaced parallel fold lines interconnected by a cut line, whereby said locking points are formed at said cut line by folding said locking flaps.

6. The blank of claim 5 and tuck flaps on opposite ends of said intermediate panel and said front panel, said tuck flaps folding to fit between said truncated triangular panel and said locking flaps.

7. The blank of claim 6 wherein at least one of said tuck flaps has a point which coincides with the position of said locking point when said blank is completed folded.

8. The blank of claim 7 and at least one locking slot in said bottom panel for securing said locking panels in place.

9. A counter top cardboard box with a flat slanting top relative to a flat bottom, said slanting top fitting between upstanding spaced parallel side walls, and an abutting means formed on the upper edges of said upstanding side walls on opposite sides of said flat slanting top, said abutting means being in a position which forms complimentary abutments when said box is inverted as compared to when it is not inverted, said box, top and abutments being shaped and proportioned to form a rectangular prism when two boxes are stacked with one box inverted over the other.

* * * * *